US006992440B2

(12) United States Patent
Ishida

(10) Patent No.: US 6,992,440 B2
(45) Date of Patent: Jan. 31, 2006

(54) LIGHT-EMITTING DEVICE AND PROCESS FOR ITS PRODUCTION

(75) Inventor: Mizuho Ishida, Yokohama (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/991,384

(22) Filed: Nov. 19, 2004

(65) Prior Publication Data

US 2005/0189877 A1 Sep. 1, 2005

(30) Foreign Application Priority Data

Feb. 26, 2004 (JP) ..... 2004-051776

(51) Int. Cl.
*H01J 61/30* (2006.01)
*H01J 29/10* (2006.01)

(52) U.S. Cl. ..... 313/512; 313/461

(58) Field of Classification Search ..... 315/169.2, 315/169.3, 169.4; 313/461, 463, 512, 231.31
See application file for complete search history.

(56) References Cited

U.S. PATENT DOCUMENTS

| | | | | |
|---|---|---|---|---|
| 6,259,212 | B1 * | 7/2001 | Song | 315/169.4 |
| 6,373,195 | B1 * | 4/2002 | Whang et al. | 315/169.3 |
| 6,395,807 | B1 | 5/2002 | Kinose et al. | 523/443 |
| 6,659,828 | B1 * | 12/2003 | Seibold et al. | 445/25 |
| 2002/0055563 | A1 | 5/2002 | Asano et al. | 524/100 |
| 2002/0175633 | A1 * | 11/2002 | Makino | 315/169.1 |

FOREIGN PATENT DOCUMENTS

| | | |
|---|---|---|
| JP | 2000-63630 | 2/2000 |
| JP | 2001-23525 | 1/2001 |
| JP | 2001-35380 | 2/2001 |
| JP | 2001-207152 | 7/2001 |
| JP | 2002-88262 | 3/2002 |
| JP | 2002-367522 | 12/2002 |
| JP | 2003-41247 | 2/2003 |
| JP | 2003-41248 | 2/2003 |
| JP | 2003-82343 | 3/2003 |
| JP | 2003-82344 | 3/2003 |
| JP | 2003-82345 | 3/2003 |
| JP | 2003-109503 | 4/2003 |
| JP | 2003-522369 | 7/2003 |
| JP | 2004-162039 | 6/2004 |

* cited by examiner

*Primary Examiner*—Wilson Lee
*Assistant Examiner*—Minh Dieu A
(74) *Attorney, Agent, or Firm*—Oblon, Spivak, McClelland, Maier & Neustadt, P.C.

(57) ABSTRACT

To provide a light-emitting device having an airtight container sealed at a lower temperature by means of a sealing material not containing a harmful component such as lead, which is free from heat deterioration of a phosphor, particularly a blue-emitting phosphor.

A light-emitting device having an airtight container sealed by means of a sealing composition comprising a curable methylphenyl silicone resin and a refractory filler, wherein the amount of the refractory filler based on the sum of the methylphenyl silicone resin and the refractory filler in the sealing composition, is from 10 to 80 mass %, and the methylphenyl silicone resin has a molar ratio of phenyl groups to methyl groups (i.e. mols of phenyl groups/mols of methyl groups) of from 0.1 to 1.2.

20 Claims, 3 Drawing Sheets

LIGHT-EMITTING DEVICE AND PROCESS FOR ITS PRODUCTION

BACKGROUND OF THE INVENTION

1. Field of the Invention

The present invention relates to a light-emitting device, more particularly, to a flat plate type light-emitting device such as a flat fluorescent screen to be used, for example, as a backlight for a liquid crystal display device, and a process for its production.

2. Discussion of Background

As a light-emitting device employing an airtight container, a flat fluorescent screen, fluorescent tube or plasma display panel (PDP) employing gas discharge, a cathode ray tube (CRT) utilizing electron beam, a vacuum fluorescent display (VFD), a field emission display (FED) an electroluminescent display (EL) including organic EL, or an electric lamp employing emission by heating, is, for example, known. One having a single display dot is called a single tube, and one having plural display dots is called a multi tube. For a flat fluorescent screen to be used as e.g. a backlight for a liquid crystal display device, in order to make the device thin, it is preferred to employ an airtight container using flat plate type front and rear substrates.

For a flat plate type light-emitting device employing gas discharge, like a flat fluorescent screen, electrodes, a dielectric layer and a phosphor layer are formed on the surface of glass plates constituting a front substrate and a rear substrate, and then the joint portion between the front substrate and a spacer component and the joint portion between the rear substrate and the spacer component, are airtightly sealed by means of a glass sealing material such as a lead-containing frit glass in a state where the front substrate and the rear substrate are maintained to have a certain distance by the spacer component (spacer), to form an airtight container. Then, the container is evacuated through an exhaust pipe attached to the airtight container or through a hole formed on the glass substrate to bring the interior to a predetermined vacuum degree, and then a discharge gas will be sealed in to a prescribed pressure. After sealing the discharge gas, the exhaust pipe attached to the airtight container is cut, and the hole formed in the substrate for evacuation, is sealed by glass and a glass sealing material.

Further, instead of the above-described procedure, there may be a case wherein after forming electrodes, a dielectric layer and a phosphor layer on the surface of glass plates constituting the front substrate and the rear substrate, the front substrate, the rear substrate and the spacer component are dried in vacuum in a vacuum chamber, and then, in a state where the interior of the chamber is substituted by a prescribed discharge gas atmosphere, the joint portion between the front substrate and the spacer component, and the joint portion between the rear substrate and the spacer component, are airtightly sealed with a glass sealing material, to form an airtight container having the discharge gas sealed in.

In order to let the flat fluorescent screen thus formed, emit light efficiently, it is necessary to set the discharge distance to be constant, which is determined by the distance between the front substrate and the rear substrate.

For sealing of an airtight container for a light-emitting device employing gas discharge like a flat fluorescent screen, it is common to employ a lead-containing low melting point glass as a glass sealing material (JP-A-2003-522369), and airtight sealing is carried out at a temperature of from 400° C. to 550° C., which is a temperature of at least the softening point of the glass for sealing. Other than the lead-containing low melting point glass, a bismuth-containing low melting point glass or one formed by a laminate of the lead-containing low melting point glass and the bismuth-containing low melting point glass, may also be used. The color temperature of white color of the flat fluorescent screen which is airtightly sealed by means of a lead-containing low melting point glass, tends to be low due to deterioration of the phosphor by heat. Among phosphors for three primary colors, a blue-emitting phosphor is particularly susceptible to deterioration by heat, and a study is being made to complement the deteriorated portion by increasing the amount or the coating area of the blue-emitting phosphor, or to convert it to a material system hardly susceptible to heat deterioration by improving the composition of the blue-emitting phosphor (JP-A-2003-82344, JP-A-2003-82345) or to apply a coating on the surface of blue-emitting phosphor particles (JP-A-2003-82343, JP-A-2003-41247, JP-A-2003-41248).

Further, a study is also being made to suppress deterioration of a blue-emitting phosphor by using a dry gas for the atmosphere in a heating step such as a firing step for phosphor layer, a preliminary firing step for low melting point glass, a sealing step or an evacuation step (JP-A-2003-109503, JP-A-2002-367522). Further, a study is also being made on the composition of a discharge gas to prevent deterioration of a blue-emitting phosphor in an aging step (JP-A-2001-35380, JP-A-2001-23525). Furthermore, as a sealing agent for sealing glass to be used for sealing a vacuum fluorescent display or the like, a sealing composition is known which comprises a curable silicone resin and a refractory filler (JP-A-2001-207152).

Namely, for sealing of an airtight container for a light-emitting device employing gas discharge, like a flat fluorescent screen, a lead-containing low melting point glass has heretofore been used as a sealing material to carry out airtight sealing at a temperature of from 400 to 550° C. In the sealing employing a lead-containing low melting point glass, the phosphor undergoes heat deterioration to cause a decrease in the color temperature or the luminance, in a preliminarily firing step for low melting point glass or a sealing step. A blue-emitting phosphor is particularly susceptible to heat deterioration, and many studies have been made such as to increase the amount of the blue-emitting phosphor, to increase the heat deterioration resistance by improving the composition of the phosphor or by coating the surface of phosphor particles, and to carry out heat treatment in a dry gas atmosphere to avoid deterioration of the blue-emitting phosphor in a heating step such as a firing step for phosphor layer, a preliminary firing step for low melting point glass, a sealing step or an evacuation step, but adequately satisfactory color temperature characteristics have not yet been obtained. Further, the conventional sealing step includes a heating step at a temperature of from 400 to 550° C., whereby there is a problem such that the energy consumption is high, or the operation time is long, leading to a high cost. Further, the conventional glass sealing material contains a lead component to lower the melting point, but the hazardous nature of lead has been pointed out, and it is desired to develop a light-emitting device having an airtight container sealed by means of a sealing material not containing a hazardous component such as lead or cadmium. As a sealing material not containing a hazardous component such as lead or the like, a material such as phosphate glass is available, but such a material has a problem that the bond strength at the sealed portion is weak.

SUMMARY OF THE INVENTION

Accordingly, it is an object of the present invention to provide a light-emitting device having an airtight container sealed at a lower temperature by means of a sealing material not containing a harmful component such as lead, which is free from heat deterioration of a phosphor, particularly a blue-emitting phosphor, and a process for producing such a light-emitting device.

The present invention is one made to accomplish the above object. Namely, the present invention provides a light-emitting device having an airtight container constituted by a front substrate, a rear substrate disposed to face the front substrate and a spacer component disposed between the front substrate and the rear substrate to maintain a certain distance between the front substrate and the rear substrate, wherein a joint portion between the front substrate and the spacer component and a joint portion between the rear substrate and the spacer component, are sealed with sealing materials, at least one of the sealing materials used at the two joint portions is made of a sealing composition comprising a curable methylphenyl silicone resin and a refractory filler, the amount of the refractory filler based on the sum of the methylphenyl silicone resin and the refractory filler in the sealing composition, is from 10 to 80 mass %, and the methylphenyl silicone resin has a molar ratio of phenyl groups to methyl groups (i.e. mols of phenyl groups/mols of methyl groups) of from 0.1 to 1.2.

In the light-emitting device of the present invention, the molar ratio of bifunctional silicon units to (the sum of bifunctional silicon units and trifunctional silicon units) (i.e. mols of bifunctional silicon units/(total mols of bifunctional silicon units and trifunctional silicon units)) in the methylphenyl silicone resin is preferably from 0.05 to 0.55.

In the light-emitting device of the present invention, wherein the refractory filler is preferably spherical silica having an average particle diameter of from 0.1 to 20 $\mu$m.

Further, the present invention provides a process for producing a light-emitting device, which comprises applying a sealing composition to a joint surface between a front substrate and a spacer component or to a joint surface between a rear substrate and the spacer component and then, heating and curing the sealing composition to form an airtight container, wherein the sealing composition comprises a curable methylphenyl silicone resin and a refractory filler, the amount of the refractory filler based on the sum of the methylphenyl silicone resin and the refractory filler in the sealing composition, is from 10 to 80 mass %, the methylphenyl silicone resin has a molar ratio of phenyl groups to methyl groups (i.e. mols of phenyl groups/mols of methyl groups) of from 0.1 to 1.2, the methylphenyl silicone resin has a molar ratio of bifunctional silicon units to (the sum of bifunctional silicon units and trifunctional silicon units) (i.e. mols of bifunctional silicon units/(total mols of bifunctional silicon units and trifunctional silicon units)) of from 0.05 to 0.55, and the refractory filler is spherical silica having an average particle diameter of from 0.1 to 20 $\mu$m.

In the light-emitting device of the present invention, the joint portion between the front substrate and the spacer component or the joint portion between the rear substrate and the spacer component, constituting the airtight container, is sealed with the sealing composition of the present invention comprising a curable methylphenyl silicone resin and a refractory filler, and accordingly, the sealing is carried out at a temperature far lower (130 to 250° C.) than a case where a conventional lead-containing glass sealing material (400 to 550° C.) is used. Therefore, heat deterioration of the phosphor in the airtight container during the sealing is reduced, and the decrease in the color temperature due to heat deterioration of the phosphor, is improved.

Further, the sealing is carried out by using the sealing composition not containing lead, of which harmfulness has been pointed out, thus being excellent in environmental sanitation.

The light-emitting device of the present invention may be a flat plate type light-emitting device like a flat fluorescent screen to be used as e.g. a backlight for a liquid crystal display device, outdoor or indoor lighting, or a reading light source for office automation equipment such as a facsimile machine, an image scanner or a copying machine.

In the process for producing a light-emitting device of the present invention, the sealing composition of the present invention comprising a curable methylphenyl silicone resin and a refractory filler, is used for sealing the airtight container, whereby the sealing temperature is substantially lowered as compared with sealing with the conventional lead-containing glass sealing material.

Thus, energy consumption or the operation time can be reduced, thus leading to energy saving or cost saving.

MEANING OF REFERENCE SYMBOLS

Figure 1:
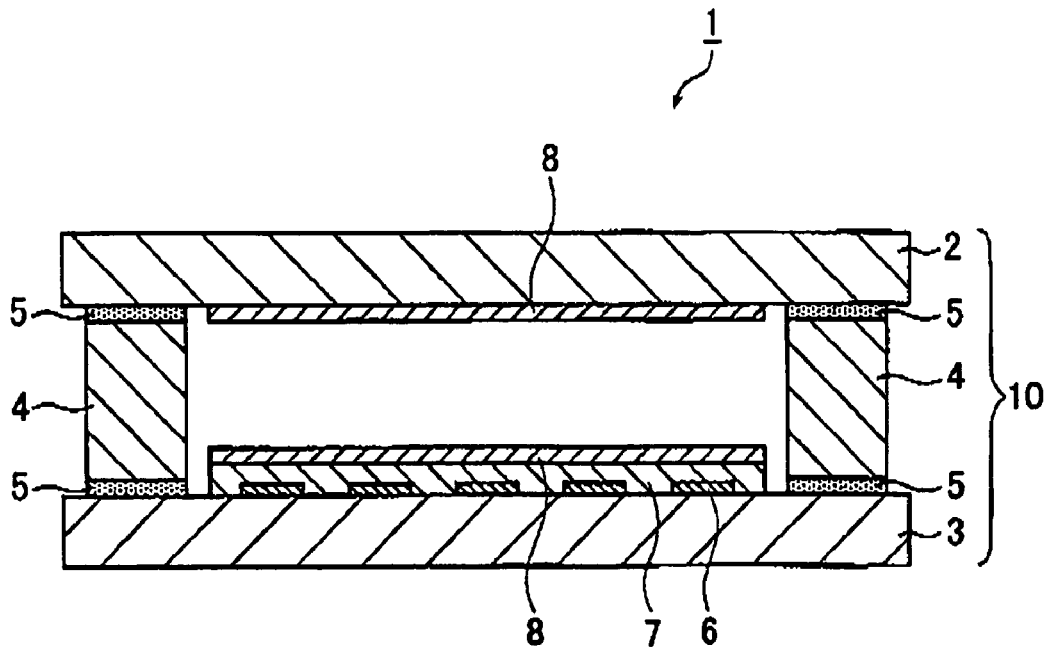
FIG. 1 is a cross-sectional view showing one embodiment of the light-emitting device of the present invention.

1: Light-emitting device (flat fluorescent screen)
2: Front substrate
3: Rear substrate
4: Spacer component
5: Sealing material
6: Electrode
7: Dielectric layer
8: Phosphor layer
10: Airtight container
12: Exhaust hole
13: Exhaust pipe
14: Sealing plate
20: Lower plate
30: Upper plate
31: Hole
40: Intermediate plate
60, 61: Soda lime glass plates Now, the present invention will be described further with reference to the drawings. FIG. 1 is a cross-sectional view of one embodiment of the light-emitting device of the present invention.

The light-emitting device 1 shown in FIG. 1 has a front substrate 2 and a rear substrate 3 disposed to face each other. Between the front substrate 2 and the rear substrate 3, a spacer component 4 is disposed.

The spacer component 4 has a role as a spacer to maintain the front substrate 2 and the rear substrate 3 as spaced with a certain distance. The joint portion between the front substrate 2 and the spacer component 4, and the joint portion between the rear substrate 3 and the spacer component 4, are airtightly sealed with a sealing material 5. An airtight container 10 for the light-emitting device 1 is constituted by the front substrate 2, the rear substrate 3 and the spacer component 4, with the joint portions thus airtightly sealed with the sealing material 5.

On the inside surface of the rear substrate 3, electrodes 6 for electrical discharge are formed by screen printing, vapor deposition or the like. The electrodes 6 are disposed so that adjacent electrodes 6 constitute counter electrodes to each other. On the rear substrate 3, a dielectric layer 7 is further formed by screen printing, vapor deposition or the like to cover the electrodes 6. On the dielectric layer 7, a phosphor layer 8 is formed. In the same manner, also on the inside surface of the front substrate 2, a phosphor layer 8 is formed. A discharge gas such as a rare gas or mercury, is filled in the airtight container 10 which is airtightly sealed.

When an alternating voltage with an amplitude exceeding the discharge voltage, is applied to the electrodes 6 of the light-emitting device having the above-described construction, discharge will occur in the space in the airtight container 10 via the dielectric layer 7. By this discharge, the discharge gas filled in the space in the airtight container 10 will be excited to radiate ultraviolet rays. By the ultraviolet rays, the phosphor layers 8 formed on the front substrate 2 and on the rear substrate 3 will emit light.

In the construction as shown, the light-emitting device 1 of the present invention is characterized in that the joint portion between the front substrate 2 and the spacer component 4, and the joint portion between the rear substrate 3 and the spacer component 4, are sealed with the specific sealing composition which will be described hereinafter (hereinafter referred to as "the sealing composition of the present invention"). More specifically, by a cured product obtained from the sealing composition of the present invention, or by a cured product obtained from a molded product of the sealing composition, which will be described hereinafter, the joint portion of the front substrate 2 and the spacer component 4, and the joint portion between the rear substrate 3 and the spacer component 4, are sealed.

The sealing composition of the present invention comprises a curable methylphenyl silicone resin and a refractory filler. Silanol groups in the curable methylphenyl silicone resin have affinity to the surface of the refractory filler, whereby mixing of the curable methylphenyl silicone resin with the refractory filler can be uniformly and freely controlled. As a result, a semi-cured product which is capable of sufficiently providing the properties of both the curable methylphenyl silicone resin and the refractory filler, can be obtained, and a sealing material as such a semi-cured product is particularly suitable for sealing between a glass component and a metal component. Namely, it has many properties simultaneously, such that it is capable of bonding the glass component at a low temperature, the bond strength is high, it is excellent in the bonding processability, the mechanical heat resistance is high over a long period of time, the gas leakage resistance is good, the airtightness-holding property is high, and the heat resistant dimensional stability is good.

The curable silicone resin is generally excellent in the heat resistance, weather resistance, moisture resistance, electrical properties, etc., and is thus widely used as a material for electric, electronic or precision instruments, etc. Also it is known to incorporate a reinforcing filler such as silica thereto to improve the strength. Further, a curable silicone resin modified with an epoxy resin is excellent in the strength, heat resistance, moisture resistance and release properties, and a composition is known which has a filler such as silica incorporated thereto to improve the fluidity or the mechanical strength of the molded product (JP-A-7-316398). The curable silicone resin or its modified resin has a relatively small modulus of elasticity, whereby it is capable of reducing the stress exerted to the glass component to be sealed, and a strain due to a difference in the thermal expansion coefficients, can be reduced.

The curable silicone resin is usually produced from a bifunctional silicon monomer ($R_2Si—X_2$) and a trifunctional silicon monomer ($RSi—X_3$), and in some cases, a monofunctional silicon monomer ($R_3Si—X$) or a tetrafunctional silicon monomer ($Si—X_4$) may be combined for use. Here, R represents an organic group having carbon atom at the bonding terminal. Further, in the curable methylphenyl silicone resin in the present invention, R is preferably a $C_{1-4}$ alkyl group or a $C_{6-12}$ monovalent organic hydrocarbon, more preferably a methyl group, an ethyl group or a phenyl group. X is a hydroxyl group, or a hydrolyzable group such as an alkoxy group or a chlorine atom. In the curable methylphenyl silicone resin in the present invention, X is preferably a hydroxyl group. The curable silicone resin is a copolymer obtainable by subjecting these monomers to partial hydrolysis and cocondensation and has silanol groups formed by the hydrolysis of X. Such a curable silicone resin is capable of condensation further by such silanol groups (curable), and by the curing, it finally turns into a cured product having substantially no silanol group. The cured product comprises bifunctional silicon units ($R_2SiO$) and trifunctional silicon units ($RSiO_{3/2}$) and in some cases, has monofunctional silicon units ($R_3SiO_{1/2}$) or tetrafunctional silicon units ($SiO_2$) The respective silicon units in the curable silicone resin are meant for the respective silicon units of such cured product and the respective silicon units which are formed by hydrolysis of X and which contain silanol groups contributing to the curability of the silicone resin. For example, a bifunctional silicon unit having a silanol group is represented by ($R_2Si(OH)—$), and a trifunctional silicon unit having a silanol group is represented by ($RSi(OH)_2—$) or ($RSi(OH)═$). Further, molar ratios of the respective silicon units in the curable silicone resin are considered to be equal to the molar ratios of the respective silicon monomers as the starting materials.

The curable methylphenyl silicone resin preferably has a Si—O/Si—R value of from 11.0 to 15.2 as obtained from FT-IR. Namely, this is a value obtained by dividing the Si—O peak area (the peak appearing within a range of from 1,250 to 950 $cm^{-1}$) (a) by the sum of the methyl group-derived peak area (the peak appearing within a range of from 1,330 to 1,250 $cm^{-1}$) (b) and the value obtained by multiplying the value (c) of mols of phenyl groups/mols of methyl groups, obtained from H-NMR by the methyl group-derived peak area (b).

$$(a)/[(b)+(c)\times(b)]=11.0 \text{ to } 15.2$$

Generally, as the alkyl group bonded to Si of the curable silicone resin becomes a long chain, the heat resistance decreases. Further, an aromatic hydrocarbon group represented by a phenyl group has a mechanical heat resistance which is equal to or higher than a methyl group as the shortest alkyl group, and as its mass ratio increases, the coating film of the resin hardens, while the resin tends to be thermoplastic. Accordingly, by the ratio of the number of phenyl groups to the total number of R in the resin, the mechanical strength such as the heat resistance or flexibility of the resin can be adjusted. As the curable methylphenyl silicone resin in the sealing composition of the present invention, the value of mols of phenyl groups/mols of methyl groups, obtained from H-NMR, is preferably from 0.1 to 1.2, more preferably from 0.3 to 0.9. In other words, a methylphenyl silicone resin is preferred wherein the ratio of the number of phenyl groups to the total number of R in the resin is from 0.1 to 0.5, more preferably from 0.2 to 0.5. Further, a methylphenyl silicone resin is also preferred wherein the phenyl group-derived peak height (3,074 $cm^{-1}$)/ the methyl group-derived peak height (2,996 $cm^{-1}$), obtained from FT-IR, is from 0.1 to 1.2.

In the sealing composition of the present invention, the curable methylphenyl silicone resin has a molar ratio of bifunctional silicon units to (the sum of bifunctional silicon units and trifunctional silicon units) (hereinafter referred to also simply as the molar ratio of bifunctional silicon units) of from 0.05 to 0.55. Here, the curable methylphenyl silicone resin is a curable silicone resin containing both methyl groups and phenyl groups as the above organic group R. The curable methylphenyl silicone resin may, for example, be produced by e.g. a method of subjecting dichlorodimethylsilane and trichlorophenylsilane to hydrolysis and co-condensation, or a method of subjecting dichlorodiphenylsilane and trichloromethylsilane to hydrolysis and co-condensation. The molar ratio of bifunctional silicone units in the curable methylphenyl silicone resin is more preferably from 0.2 to 0.4. Further, this curable methylphenyl silicone resin is preferably one composed substantially solely of bifunctional silicon units and trifunctional silicon units. Such a curable methylphenyl silicone resin is also excellent in heat resistance without readily undergoing decomposition or color change even if held at a high temperature of at least 250° C. for a long period of time.

Here, the above-mentioned molar ratio of bifunctional silicon units is one obtained from Si-NMR.

To the curable methylphenyl silicone resin, a curable dialkylsilicone resin such as a dimethylsilicone resin, or a curable alkylphenyl silicone resin other than a methylphenyl silicone resin, such as an ethylphenyl silicone resin, may be incorporated in a small amount to adjust the physical properties. However, usually, it is preferred not to use such a curable silicone resin other than the curable methylphenyl silicone resin. Further, the curable methylphenyl silicone resin may be used as modified with an epoxy resin, a phenol resin, an alkyd resin, a polyester resin or an acrylic resin. However, it is preferred that the amount of the modifying resin is small, and as the curable methylphenyl silicone resin, a curable methylphenyl silicone resin not substantially modified, is preferred.

The curable methylphenyl silicone resin is usually subjected to handling such as transportation or storage in the form of a solution (varnish) as dissolved in a solvent. As the sealing composition of the present invention, such a varnish is employed, and it may be produced by mixing such a varnish with a refractory filler. One produced in such a manner becomes a paste-form sealing composition having fluidity. Further, from the varnish, the solvent may preliminarily be removed, and then the curable methylphenyl silicone resin free from the solvent may be mixed with the refractory filler to obtain a solid sealing composition. Further, after mixing the varnish with the refractory filler, the solvent may be removed to obtain a solid sealing composition. Furthermore, the solid sealing composition may be mixed with a solvent to obtain a paste-form sealing composition.

The solvent to be used for preparing a varnish of the curable methylphenyl silicone resin is not particularly limited, and it may be any solvent so long as it is a solvent capable of dissolving the curable methylphenyl silicon resin. For example, an aromatic hydrocarbon solvent such as xylene, toluene or benzene, or a solvent having a boiling point of at most 100° C., such as methyl ethyl ketone, ethyl acetate, isopropyl acetate, diethyl ether, dipropyl ether, tetrahydrofuran, acetonitrile, propionitrile, 1-propanol, 2-propanol or allyl alcohol, may, for example, be employed. In a case where the sealing composition is used in a paste-form as dissolved in a solvent, as described hereinafter, the latter is preferred, since it is easy to remove the solvent by evaporation under heating, after coating the sealing composition.

The amount of the solvent in the varnish is preferably from 5 to 50 mass %. If it is less than 5 mass %, the solubility of the curable methylphenyl silicone resin will be inadequate, and it tends to be difficult to uniformly mix it with the refractory filler. If it exceeds 50 mass %, when mixed with the refractory filler, the solvent tends to undergo phase separation from the refractory filler, or after mixing with the refractory filler, a large energy will be required to remove the solvent.

The curable methylphenyl silicone resin may be present as a methylphenyl silicone resin partially polymerized (hereinafter referred to also simply as a partially polymerized methylphenyl silicone resin) in the sealing composition. With the partially polymerized methylphenyl silicone resin, a dehydration condensation reaction of the curable methylphenyl silicone resin as the starting material has already proceeded to some extent, and as compared with the methylphenyl silicone resin as the starting material, generation of moisture at the time of sealing the object to be sealed, is little. Accordingly, with the sealing composition containing the partially polymerized methylphenyl silicone resin, the undesirable possibility of formation of bubbles is small as compared with the methylphenyl silicone resin as the starting material at the time of curing for sealing the object to be sealed, whereby the airtightness can be improved. Further, the partially polymerized methylphenyl silicone resin is a liquid having a high viscosity or a solid having a high melt viscosity as compared with the methylphenyl silicone resin as the starting material and thus has a nature suitable for a case where the sealing composition of the present invention is formed into a molded product. For example, it is possible to minimize the possibility that the methylphenyl silicone resin is fluidized to run off the prescribed site at the time of curing a molded product of the sealing composition disposed at the prescribed site of the object to be sealed.

Here, the partially polymerized methylphenyl silicone resin is a curable methylphenyl silicone resin in a state where curing of the curable methylphenyl silicone resin as the starting material has partially progressed. The curable methylphenyl silicone resin in the present invention is meant for not only the curable methylphenyl silicone resin as a starting material for the partially polymerized methylphenyl silicone resin, but also such a partially polymerized methylphenyl silicone resin. Hereinafter, particularly, the curable methylphenyl silicone resin subjected to partial polymerization during the production of the sealing composition of the present invention will be referred to as a partially polymerized methylphenyl silicone resin.

Partial polymerization of the curable methylphenyl silicone resin is carried out usually by terminating it at a level where the curing reaction by heating the methylphenyl silicone resin as the starting material is not completely finished. For example, it is obtainable by partially curing the methylphenyl silicone resin as the starting material by a method such as heating it at a temperature lower than the usual curing reaction or heating it for a shorter time than the time required for the curing. To carry out the partial polymerization of the curable methylphenyl silicone resin, for example, polymerization is carried out at a temperature of from 120 to 180° C., and the reaction is terminated at a level where the curing reaction has not completely progressed by using as an index the viscosity of the methylphenyl silicone resin. For example, in a case where the polymerization is carried out at a temperature of 180° C., the heating may be finished at a time when the viscosity of the methylphenyl silicone resin has reached to 5,000 to 60,000 cP. The partial polymerization of the methylphenyl silicone resin as the starting material may be carried out in the composition wherein the refractory filler is present, or during the process for production of such a composition.

Curing of the curable methylphenyl silicone resin by dehydration condensation will usually proceed solely by heating, and a cured product insoluble in a solvent will be formed by a dehydration condensation reaction of the silanol groups of the resin to one another and by the dehydration condensation reaction of the silanol groups of the resin with the silanol groups on the surface of the refractory filler. For example, with respect to the sealing composition coated on the object to be sealed, the resin is cured solely by heating at a temperature of at least 140° C., preferably from 180 to 300° C., for from 1 to 120 minutes and insolubilized to form the sealing material. Usually, in a case where a solvent is contained in the sealing composition, it is evaporated and removed at the initial stage of the heating, and in a case where a non-heat resistant substance such as an organic substance is present, it will be removed by evaporation or decomposition at the time of curing. However, in order to carry out stabilized curing, it is preferred to carry out removal by evaporation of the solvent at a lower temperature prior to curing the sealing composition. Such removal by evaporation of the solvent is carried out, for example, at a temperature of from 100 to 140° C. for from 30 to 60 minutes, although it may depends upon the type of the solvent.

A curing catalyst may be employed to lower the curing temperature of the curable methylphenyl silicone resin. As such a curing catalyst, an organic acid salt of a metal such as zinc, cobalt, tin, iron or zirconium, a quaternary ammonium salt, a chelate containing a metal such as aluminum or titanium, various amines or salts thereof, may, for example, be mentioned.

The refractory filler contained in the sealing composition is a heat resistant inorganic powder. Specifically, it may, for example, be silica, alumina, mullite, zircon, cordierite, β-eucryptite, β-spodiumen, β-quartz solid solution, forsterite, bismuth titanate or barium titanate. Of course, it is possible to use them in combination.

The average particle diameter of the refractory filler is preferably from 0.1 to 130 μm, more preferably from 0.1 to 90 μm, further preferably from 0.1 to 20 μm, particularly preferably 0.1 to 10 μm. If the average particle diameter exceeds the above upper limit, cracks are likely to be formed at the interface between the refractory filler and the silicone resin after curing of the methylphenyl silicone resin, and a gas is likely to leak into the internal void spaces in the sealed structure, whereby vacuum or the desired reduced pressure may not be maintained. If the average particle diameter is less than the above lower limit, agglomeration of the powder is likely to take place, and the powder may not uniformly be dispersed in the curable methylphenyl silicone resin. Further, the viscosity increase is likely to result, whereby there will be a problem that the amount of the refractory filler to be incorporated, will be restricted.

The refractory filler is preferably silica, particularly preferably spherical silica. The average particle diameter of the spherical silica is preferably from 0.1 to 130 μm more preferably from 0.1 to 90 μm, further preferably from 0.1 to 20 μm, still further preferably from 0.1 to 10 μm. When the average particle diameter of the spherical silica is from 0.1 to 20 μm, a sealing composition excellent in the coating efficiency will be obtained. If the average particle diameter is less than the above range, the particles tend to agglomerate to one another, and the dispersibility tends to deteriorate, whereby a uniform composition tends to be hardly obtainable. On the other hand, if it exceeds the above range, the particles tend to precipitate, whereby the dispersibility tends to be poor, and again a uniform composition tends to be hardly obtainable. Further, the viscosity tends to increase, thus leading to a problem such that the amount of the refractory filler to be incorporated, will be restricted.

The amount of the refractory filler to be incorporated in the sealing composition of the present invention is from 10 to 80 mass % based on the total amount of the curable methylphenyl silicone resin and the refractory filler. If it is less than 10 mass %, no adequate heat resistance tends to be obtained. If it exceeds 80 mass %, the dispersibility in or the affinity to the methylphenyl silicone resin tends to be poor, and consequently, cracks are likely to be formed in the sealing material (the cured product), and the gas is likely to leak into the internal void spaces of the sealed structure, whereby the vacuum or the desired reduced pressure may not be maintained. Further, deterioration of the bond strength at the sealing site will result. A preferred amount of the refractory filler is from 30 to 70 mass %.

The amount of the spherical silica to be incorporated in the sealing composition, when a spherical silica having an average particle diameter of from 0.1 to 20 μm is to be incorporated, is from 10 to 80 mass %, preferably from 30 to 70 mass %, based on the sum of the curable methylphenyl silicone resin and the refractory filler. If it is less than this range, the heat resistance or the light resistance tends to be poor, and if it exceeds this range, cracks are likely to form in the sealing material, and a gas is likely to leak into the airtight container, whereby the vacuum or the desired reduced pressure may not be maintained. Further, the bond strength at the sealed site tends to deteriorate.

In the sealing composition of the present invention, in addition to the refractory filler having an average particle diameter of at most 130 μm, spherical particles having a larger particle diameter (exceeding 130 μm) and having a narrow particle size distribution, may be incorporated in a small amount as a spacer material. In a case where a refractory filler having such a large particle diameter, is to be used, spherical silica or barium titanate having a particle diameter of from 300 to 500 μm, may, for example, be preferred. The amount to be incorporated is preferably from 0.1 to 15 mass % (provided that at most 50 mass %, based on the total refractory filler), particularly preferably from 1 to 5 mass %, based on the sum of the curable methylphenyl silicone resin and the refractory filler.

The sealing composition of the present invention may contain other components in addition to the curable methylphenyl silicone resin and the refractory filler. As such other components, for example, a component other than the components finally functioning as the sealing material, such as the above-mentioned solvent, or a component remaining in the sealing material, for example, a coloring pigment for the sealing material, may be mentioned. The content of such other components in the sealing composition is not particularly limited, but is an amount not to impair the characteristics of the sealing composition of the present invention or a molded product of the sealing composition. The former component is preferably at most 20 mass % based on the sealing composition excluding the solvent. The amount of the solvent is optional depending upon the method of use of the sealing composition such that it is used in a liquid state or in a solid state, or upon others, but it is usually preferably at most 50 mass % based on the sealing composition.

Specific other components and their preferred amounts (the amounts based on the sealing composition excluding the solvent) may, for example, be as follows. At most 5 mass % of an amine type curing agent or the like to accelerate the curing of the methylphenyl silicone resin, at most 15 mass % of a pigment or the like for the purpose of further increasing the mechanical heat resistance of the sealing material or for the purpose of coloration, or at most 5 mass % of a tackiness-imparting agent such as pine resin, rosin, a rosin derivative or the like for the purpose of improving the potlife of the sealing composition, or improving the dispersibility of the refractory filler or the methylphenyl silicone resin and improvement of the sealing property, may be incorporated.

The sealing composition of the present invention may be obtained by mixing the curable methylphenyl silicone resin and the refractory filler to obtain a uniform composition. By using a solution (varnish) of the curable methylphenyl silicone resin, it may be used as a paste-form composition comprising the curable methylphenyl silicone resin, the solvent and the refractory filler. Further, the varnish and the refractory filler may be heated and mixed with stirring, and then the solvent is evaporated and removed to obtain a solid composition containing substantially no solvent. To obtain the solid composition, the temperature for evaporating and removing the solvent is usually from 100 to 180° C., preferably from 100 to 140° C., although it may depends on the type of the solvent to be used. The sealing composition of the present invention is preferably used in a paste-form containing a solvent, preferably from 10 to 30 mass % of the solvent so that it is excellent in handling efficiency. When it is used in a solid state, its shape is not particularly limited, and it may be molded into a shape such as a sheet-form, a wire-form or a stick-form.

At the time of producing the above sealing composition, the curable methylphenyl silicone resin may be partially polymerized to obtain a partially polymerized methylphenyl silicone resin. The partial polymerization of the curable methylphenyl silicone resin may be carried out before mixing the refractory filler or after mixing the refractory filler. Further, in a case where the varnish is used, the partial polymerization may be carried out in a state where the solvent is present or it may be carried out after removing the solvent. Usually, it is preferred to carry out the partial polymerization of the methylphenyl silicone resin by heating and mixing with stirring the varnish and the refractory filler as mentioned above, and the solvent is removed in such a state, followed by further increasing the temperature in that state to carry out partial polymerization of the methylphenyl silicone resin. The partial polymerization of the methylphenyl silicone resin is carried out at a temperature of from 120 to 180° C. by using as an index the viscosity of the composition containing a methylphenyl silicone resin, to terminate the reaction before the curing reaction will completely proceed. In a case where the partial polymerization is carried out at 180° C., heating may, for example, be terminated at a time when the viscosity of the composition has become from 5,000 to 60,000 cP. Further, the partial polymerization is preferably carried out at a temperature of from 120 to 140° C., whereby the curing reaction is relatively slow, and termination of the reaction using viscosity as an index is easy.

The sealing composition of the present invention containing the partially polymerized methylphenyl silicone resin may be used in the form of a molded product formed into a shape of e.g. a sheet form, a wire form or a stick form. For example, the sealing composition formed into a partially polymerized methylphenyl silicone resin by heating as described above will be a clay-like composition, and this clay-like composition in a heated state may be cast into a mold for molding. Specifically, by means of a mold made of e.g. a fluororesin, it may be formed into a molded product having a desired various shape such as a sheet form, a wire form or a stick form. The obtained molded product of the sealing composition having a shape of e.g. a sheet form, a wire form or a stick form may be applied as it is in that shape for sealing of the joint portion between the front substrate and the spacer component and the joint portion between the rear substrate and the spacer component.

On the other hand, the sealing composition of the present invention containing the partially polymerized methylphenyl silicone resin may be used in the state of a paste-form dissolved in the above-mentioned suitable solvent, which is rather preferred since it is excellent in handling efficiency. When it is used in the state of a paste-form, the amount of the solvent is as described above.

In each case, the layer thickness of the sealing composition of the present invention at the joint portions, is preferably at most 300 $\mu$m, more preferably at most 100 $\mu$m.

Other constituting elements of the light-emitting device shown in the Figs. may be widely selected from conventional ones.

The front substrate 2 is required to have light transmittance and is made of a transparent or translucent material, and it is usually made of glass such as soda lime glass, borosilicate glass or silica glass or may be made of a transparent or translucent resin. In the case of soda lime glass, so-called white plate is preferred, since it is excellent in light transmittance. On the other hand, the rear substrate 3 and the spacer component 4 are not required to have light transmittance, and they may be made of an opaque resin or ceramic in addition to the above material.

As the material for electrodes 6, silver, aluminum, nickel, copper, carbon or ITO (indium tin oxide) may, for example, be used. In the light-emitting device 1 shown, electrodes 6 are formed on the rear substrate 3. However, since ITO is excellent in light transmittance, electrodes may be formed also on the front substrate 2. In such a case, electrodes on the front substrate 2 and electrodes 6 on the rear substrate 3 will constitute counter electrodes to each other.

The dielectric layer 7 is a layer having a function to prevent dielectric breakdown due to discharge or damage to electrodes, and it is, for example, a layer of lead oxide. On the dielectric layer 7, a protective layer made of e.g. MgO may be formed. The protective layer lowers the discharge voltage by a secondary-emission function, a charge storage function, etc., and at the same time plays a role to protect the dielectric layer 7 from discharge.

The phosphor constituting the phosphor layer 8 may, for example, be green-emitting $Zn_2SiO_4$:Mn, (Ba,Sr,Mg)O. $aAl_2O_3$:Mn, (Y,Gb)$BO_3$:Tb, $YBO_3$:Tb or the like, red-emitting (Y,Gd)$BO_3$:Eu, $Y_2O_3$:Eu, $(Y,Gb)_2O_3$ or the like, or blue-emitting $BaMgAl_{10}O_{17}$:Eu, $BaMgAl_{14}O_{23}$:Eu or the like. By using narrow band emitting phosphors of these three primary colors, it is possible to obtain a white color emission having high luminance. Further, phosphors to be used for common fluorescent lamps, such as halophosphate type phosphors may also be used. Now, the process for producing a light-emitting device of the present invention will be described with reference to a case where the light-emitting device shown in FIG. 1 is to be produced.

Firstly, electrodes 6 are formed on a rear substrate 3. The electrodes 6 may be formed by a method of screen printing silver, aluminum, nickel, copper, carbon, ITO (indium tin oxide) or the like as a conductive paste and drying it, followed by firing, a method of vapor depositing or sputtering via a mask, or a method of etching the vapor deposited or sputtered film of such a material.

Then, a dielectric layer 7 is formed to cover the electrodes 6. The dielectric layer 7 may be formed by screen printing a low melting point glass such as lead oxide, or melting and coating such a glass, followed by drying and firing.

Then, a phosphor layer 8 is formed on the dielectric layer 7. The phosphor layer 8 may be formed by screen printing a desired phosphor, or dissolving it in a desired solvent, followed by coating, drying and then firing. In the same manner, also on the front substrate 1, a phosphor is screen-printed or dissolved in a desired solvent, followed by coating, drying and firing, to form a phosphor layer 8.

Then, the sealing composition of the present invention is disposed along the peripheral portion of the rear substrate 3 on the side having electrodes 6 formed. Here, in the case of a paste-form sealing composition (inclusive of a composition containing a partially polymerized methylphenyl silicone resin) containing a solvent, it may be applied to the object to be sealed, by a brush, a spray, a dispenser or the like. On the other hand, in a case where a molded product of the sealing composition (inclusive of a molded product containing a partially polymerized methylphenyl silicone resin) in a sheet form or the like, the molded product is disposed as it is at a prescribed position on the rear substrate 3 heated to a prescribed temperature. Disposition of the sealing composition of the present invention may be carried out by other method. For example, it may be carried out, for example, by a spray method, a screen printing method or a spin coating method.

Then, to cover the sealing composition, a spacer component 4 is placed along the peripheral portion of the rear substrate 3. On the upper surface of the spacer component 4 thus placed, the sealing composition of the present invention will be disposed in the same procedure as described above. Then, on the spacer component 4, the front substrate 2 is placed so that the surface having the phosphor layer 8 formed, will be located inside.

In a case where the paste-form sealing composition containing a solvent is used, it is preferred to heat the sealing composition to a prescribed temperature after applying it on the rear substrate 3 and before placing the spacer component 4, to evaporate and remove the solvent. Likewise, it is preferred to evaporate and remove the solvent after coating the sealing composition on the spacer component 4 and before placing the front substrate 2.

The rear substrate 3, the spacer component 4 and the front substrate 2 are overlaid in this order, whereupon the sealing composition is heated and cured by heating under a prescribed temperature condition, for example, at a temperature of at least 140° C., preferably from 180 to 300° C. for from 1 to 120 minutes, while exerting a pressure from above the front substrate 2. In sealing employing conventional frit glass, it is required to heat frit glass to a temperature of from 400 to 550° C. i.e. a temperature of at least the softening temperature of the frit glass. Whereas, by using the sealing composition of the present invention, the sealing temperature is substantially lowered, whereby heat deterioration of the phosphor during the sealing will be reduced, and a decrease in the color temperature to be caused by heat deterioration of the phosphor, will be improved.

With respect to the structure of the light-emitting device shown in FIG. 1, various changes are possible. For example, the phosphor layer 8 may be provided only on the inside surface of the front substrate 2. In such a case, no phosphor layer is present on the rear substrate side, whereby the sealing material to be used at the joint portion between the rear substrate 3 and the spacer component 4, is not required to be sealed at a low temperature. Accordingly, for sealing of this joint portion, a sealing material such as conventional glass frit, may be used for the sealing. Such a light-emitting device may be assembled by firstly bonding the spacer component 4 to the rear substrate 3 having electrodes 6 and a dielectric layer 7 formed, and then sealing the front substrate 2 having a phosphor layer 8 formed, on this spacer component 4, by means of the sealing composition of the present invention. Further, even for such a light-emitting device, the sealing composition of the present invention may be employed as a sealing material to be used at the joint portion between the rear substrate 3 and the spacer component 4.

A preferred light-emitting device of the present invention is a light-emitting device of the structure shown in FIG. 1, i.e. a light-emitting device 1 which has a phosphor layer 8 also on the dielectric layer 7 and wherein the joint portion between the front substrate 2 and the spacer component 4 and the joint portion between the rear substrate 3 and the spacer component 4 are both sealed by means of the sealing composition of the present invention.

Figure 2:
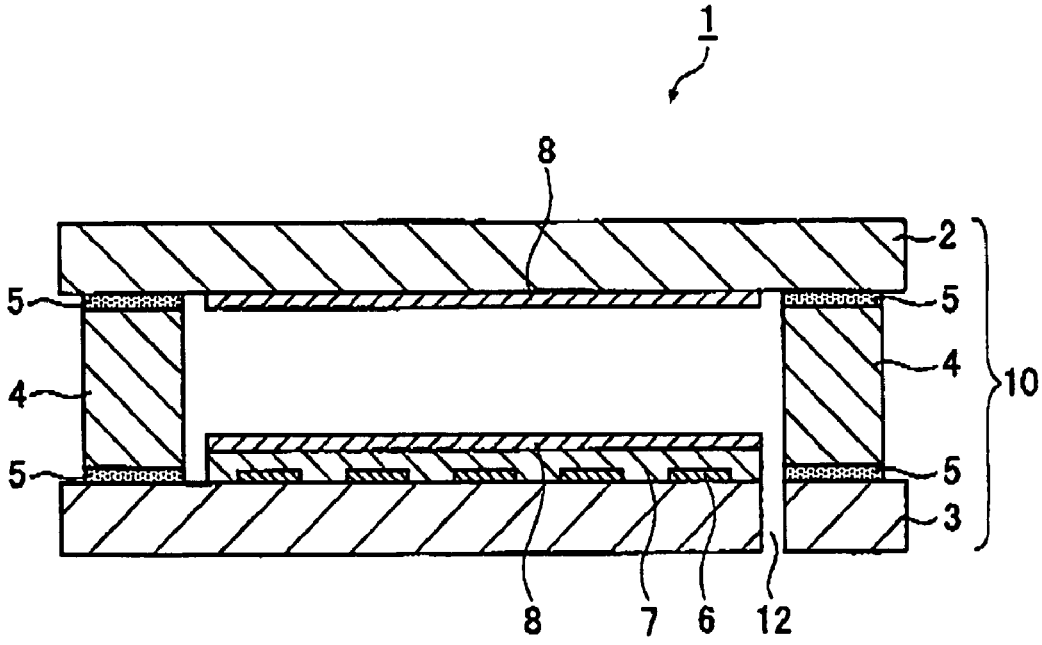
FIG. 2 is a cross-sectional view showing the light-emitting device before evacuation.
Figure 3:
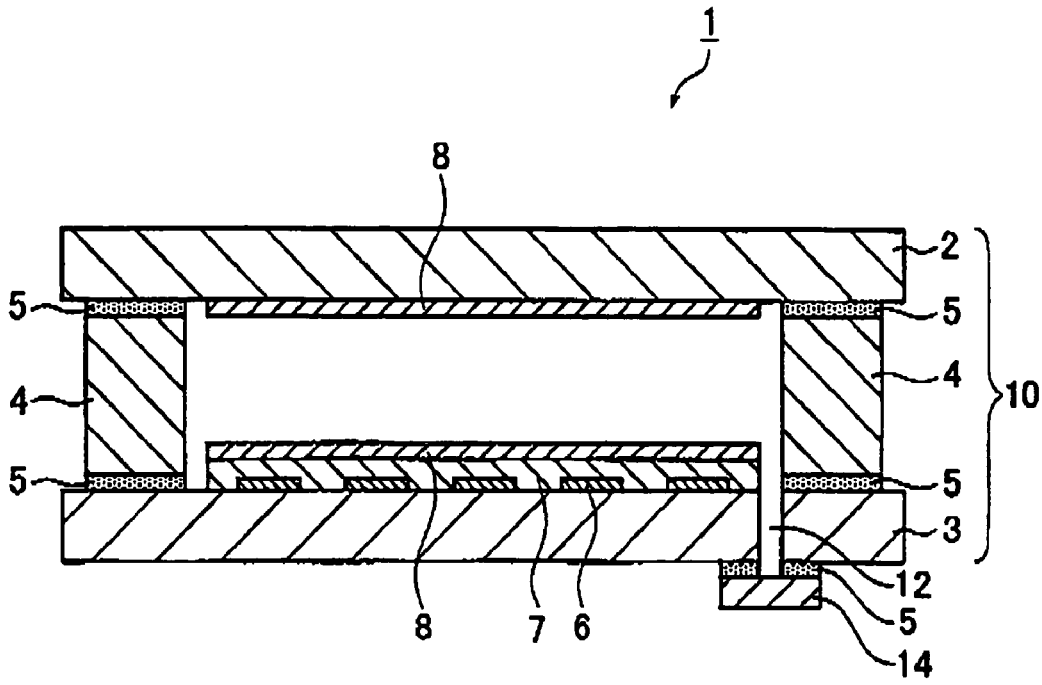
FIG. 3 is a cross-sectional view showing the light-emitting device of FIG. 2 after sealing an exhaust hole with a sealing plate after the evacuation.

FIG. 2 is a cross-sectional view of a light-emitting device after the sealing composition has been heated and cured. On the rear substrate 3 of the light-emitting device 1 in FIG. 2, an exhaust hole 12 having a diameter of 2 mm is, for example, provided to evacuate the interior of the airtight container 10. To this exhaust hole 12, a vacuum pump is connected to evacuate the interior of the airtight container 10, and then, a discharge gas which is a rare gas or a gas mixture of a rare gas and mercury, will be filled to a pressure of from a few kPa to a few 100 kPa. When the discharge gas is filled in the airtight container 10 to a prescribed pressure, as shown in FIG. 3, the opening of the exhaust hole 12 is sealed by means of a sealing plate 14 and the sealing composition of the present invention, to obtain a light-emitting device 1 of the present invention. In FIG. 3, the sealing material 5 is present only on the joint surface between the rear substrate 3 and the sealing plate 14, but in a state where the sealing composition of the present invention is applied on the entire upper surface of the sealing plate 14, the rear substrate 3 may be bonded thereto. As the sealing plate 14, a glass plate is suitable, but it is not limited thereto.

Figure 4:
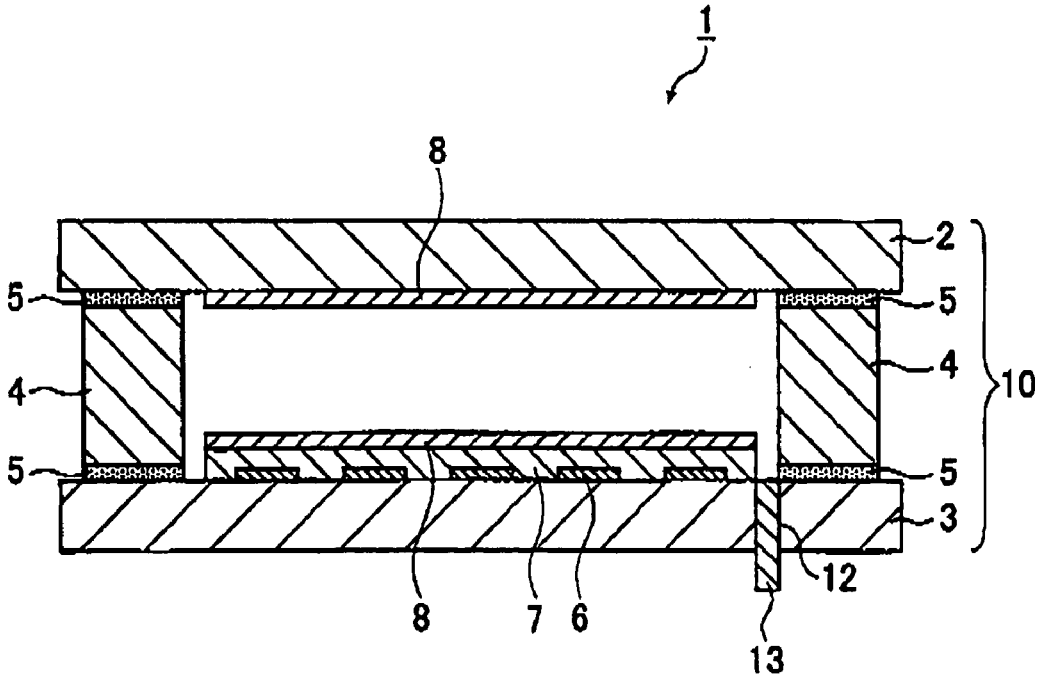
FIG. 4 is a view similar to FIG. 2, but an exhaust pipe is inserted in the exhaust hole.

The means to evacuate the interior of the airtight container 10 is not limited to the above embodiment. FIG. 4 is a view similar to FIG. 2, but an exhaust pipe 13 made of glass is inserted in the exhaust hole 12. The exhaust pipe 13 is fixed to the inner wall of the exhaust hole 12 by means of the sealing composition of the present invention or conventional frit glass. With this light-emitting device 1, a vacuum pump will be connected to the exhaust pipe 13 to evacuate the interior of the airtight container 10. After the interior of the airtight container 10 is evacuated, and a discharge gas is filled to a prescribed pressure, the exhaust pipe 13 is burned off to seal the exhaust hole 12. Otherwise, after cutting the exhaust pipe 13 off, the exhaust hole 12 may be sealed by means of a sealing plate and the sealing composition of the present invention, in the same manner as described above.

The following means may be employed as another means. As mentioned above, a phosphor layer 8 is formed on the front substrate 2, and on the rear substrate 3, electrodes 6, a dielectric layer 7 and a phosphor layer 8 are formed. Then, the sealing composition of the present invention is disposed at the sites where the front substrate 2, the rear substrate 3 and the spacer component 4 are to be bonded. The sealing composition of the present invention may be applied as a paste-form sealing composition containing a solvent, or may be disposed as a molded product of the sealing composition in a sheet form. Then, the front substrate 2, the rear substrate 3 and the spacer component 4 are put into a vacuum chamber, and dried under evacuation, whereupon the interior of the chamber is substituted by a discharge gas atmosphere under a prescribed pressure. In this state, the rear substrate 3, the spacer component 4 and the front substrate 2 are assembled so that they are laminated in this order, whereupon the sealing composition of the present invention is heated and cured to form an airtight container 10 having the interior filled with a discharge gas under a desired pressure.

The sealing composition in the present invention is a sealing material which is a low temperature curable and which contains no lead, and thus can be used only for sealing of the exhaust hole of an airtight container for a light-emitting device. For example, the sealing composition in the present invention may be employed as an adhesive at the time when an opening of an exhaust hole of an airtight container assembled by means of a conventional sealing agent, is to be sealed by using a sealing plate. By using the sealing composition in the present invention, sealing can be carried out in a relatively short time by reducing the thermal influence to a phosphor layer in the interior of the airtight container. Namely, the present invention also provides a light-emitting device having an airtight container constituted by a front substrate, a rear substrate disposed to face the front substrate and a spacer component disposed between the front substrate and the rear substrate to maintain a certain distance between the front substrate and the rear substrate, and a sealed exhaust hole, wherein the sealed exhaust hole is sealed by means of the above-mentioned sealing composition.

EXAMPLES

Example 1

Into a container equipped with a stirrer, 40 parts by mass (mass excluding the solvent) of a varnish containing a curable methylphenyl silicone resin having the characteristics shown in Table 1 [molar ratio of bifunctional silicon units (=bifunctional silicon units/(sum of bifunctional silicon units and trifunctional silicon unit)), mols of phenyl groups/mols of methyl groups], and 60 parts by mass of spherical silica having an average particle diameter of 3 μm, were put, heated to from 120 to 140° C. and stirred to remove the solvent. Then, the mixture was stepwisely heated to from 150 to 180° C., and the curable methylphenyl silicone resin was partially polymerized until the viscosity of the composition at 180° C. became 20,000 cp. For the measurement of the viscosity, B-type viscometer was used.

Then, the obtained solid-form sealing composition and a solvent (ethyl acetate) were mixed in a ratio shown in Table 1 to obtain a paste-form sealing composition.

In Table 1, the molar ratio of bifunctional silicon units was measured by Si-NMR and FT-IR. The molar ratio of phenyl groups was measured by H-NMR and FT-IR.

With respect to the obtained sealing composition, the following evaluation was carried out. The results are shown in Table 1.

Evaluation of Coating Efficiency

The coating efficiency at the time of applying the obtained paste-form sealing composition on a soda lime glass substrate by means of a dispenser, was evaluated based on the following evaluation standards. Further, in a case where the sealing composition was a molded product as in the following Example 3, judgment was made on the basis of whether or not the molded product was fluidized and uniformly spread, when the molded product was placed on a glass substrate heated to 180° C.

○: The sealing composition had good fluidity and was uniformly applied.

X: The sealing composition was poor in fluidity and was not uniformly applied.

Evaluation of Curability

A paste-form sealing composition was applied to an aluminum cup by means of a dispenser so that the thickness would be from 100 μm to 200 μm, then heated at 120° C. for 1 hour to evaporate and remove the solvent, then dried at 200° C. for 5 minutes and heated at 200° C. for 1 hour and at 250° C. for 1 hour to heat-cure the sealing composition to obtain a test sample. The sample was heated to 300° C., whereby the mass reduction was measured by means of a differential thermo balance (TG-DTA, manufactured by MacScience). The measurement was carried out in dry air, and the temperature raising speed was 10° C./min. The evaluation standards for evaluation of the curability are as follows.

○: The mass reduction when heated to 300° C., was at most 1%.

X: The mass reduction when heated to 300° C., was more than 1%.

Further, in a case where the sealing composition was a molded product as shown in the following Example 3, the sealing composition was applied on an aluminum cup heated to 180° C. so that the thickness would be from 100 μm to 200 μm, dried at 180° C. for 10 minutes and then heat-cured at 200° C. for 1 hour and at 250° C. for 1 hour, to obtain a test sample.

Evaluation of Leakage

Figure 5:
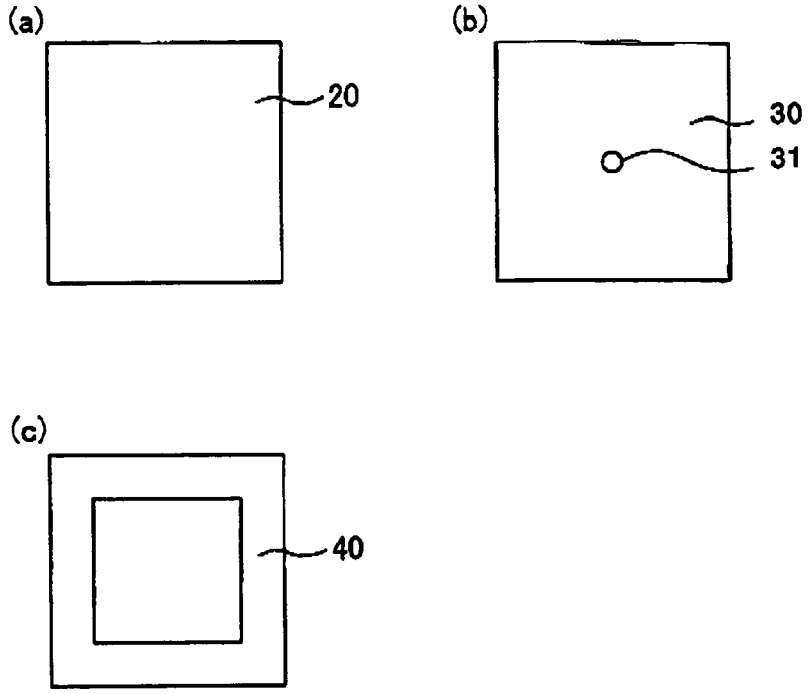
FIG. 5 are plan views of samples of three glass plates used for evaluation of the leakage, wherein (a) is a plan view of a lower plate sample, (b) is a plan view of an upper plate sample, and (c) is a plan view of an intermediate plate sample.

Evaluation of leakage was carried out by using three substrates made of soda lime glass, having the shapes as shown in FIG. 5 (lower plate 20: 100 mm×100 mm×5 mm, upper plate 30: 100 mm×100 mm×5 mm, frame-form intermediate plate 40 having a hole 31 having a diameter of 5 mm, at the center: outer diameter 100 mm×100 mm, the inner diameter 70 mm×70 mm, and the thickness 5 mm).

Along the periphery of the lower plate 20, a paste-form sealing composition was applied with a width of 15 mm by means of a dispenser. The solvent was evaporated and removed under heating at 120° C. for 1 hour, followed by further heating for 10 minutes at 180° C. On the other hand, also on the upper surface of the intermediate plate 40, the paste-form sealing composition was applied by means of a dispenser, and the solvent was evaporated and removed under heating at 120° C. for 1 hour, followed by further drying at 180° C. for 10 minutes.

Figure 6:
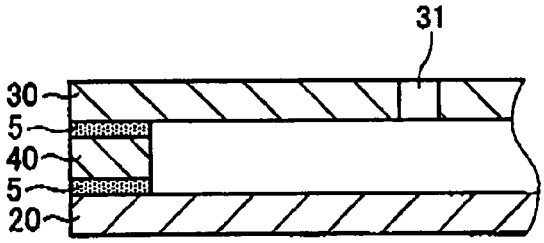
FIG. 6 is a cross-sectional view after sealing the samples of three glass substrates shown in FIG. 5.

Then, under heating at 180° C., as shown in FIG. 6, the lower plate 20, the intermediate plate 40 and the upper plate 30 were laminated in this order. In FIG. 6, the thickness of the sealing composition was 100 μm. In this state, heating and curing were carried out at 200° C. for 1 hour and at 250° C. for 1 hour while exerting pressure from above, to prepare a test sample for evaluation of leakage. Then, evacuation was carried out through the hole 31 of the upper plate 30 by means of a vacuum pump to bring the inside space to a vacuum of $1.333\times10^{-8}$ Pa·m$^3$/g. Then, presence or absence of leakage was measured.

As in Example 3 given hereinafter, in a case where the sealing composition was a molded product, the sealing composition was placed along the periphery of the lower plate 20 in a state where the lower plate 20 was heated at 180° C. and dried at 180° C. for 5 minutes. On the other hand, also on the intermediate plate 40, the sealing composition was placed in a state heated at 180° C. and dried at 180° C. for 5 minutes. Then, in a state heated at 180° C., as shown in FIG. 6, the lower plate 20, the intermediate plate 40 and the upper plate 30 were laminated in this order, and heating and curing were carried out at 200° C. for 1 hour and at 250° C. for 1 hour, while exerting a pressure from above, to obtain a test sample. The thickness of the sealing composition was 100 μm.

The measurement for the presence or absence of the leakage was carried out by a hood method employing ULVAC helium leak detector HELIOT. Firstly, the interior of the test peace was evacuated until the background value became $1.5\times10^{-11}$ Pa·m$^3$/g, then helium gas was introduced into the hood, and the leaking rate of the helium gas was measured for 10 minutes, and the maximum value of the leaking rate of the helium gas was recorded to confirm the presence or absence of leakage. The above evaluation results are shown in Table 1.

Evaluation of Bond Strength to Glass

Figure 7:
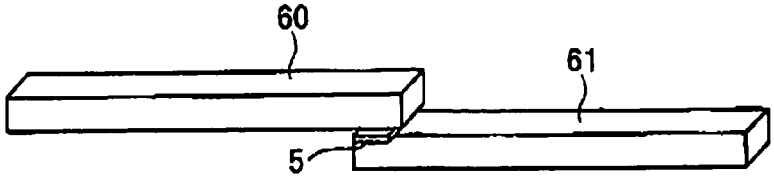
FIG. 7 is a side view of a sample used for evaluation of the bonding property to glass.

The end portions of soda lime glass plates (10 mm×100 mm×6 mm) 60 and 61 having a shape as shown in FIG. 7, were bonded with the sealing composition, to prepare a sample for evaluation of the bond strength to glass. Here, the coating, drying and heating and curing of a paste-form sealing composition, and the placing, drying and heating and curing of a molded product of the sealing composition, were carried out in the same procedure as described with respect to evaluation of the leakage. For the evaluation of the bond strength, a tensile test was carried out in the same procedure as in JIS K6850 employing Tensilon (manufactured by Orientec) to measure the bond strength of the sealed portion. The tensile speed was 5 mm/min.

Evaluation of Emission Characteristics of Light-Emitting Device

Using the sealing composition obtained as described above, as a sealing material, the light-emitting device 1 shown in FIG. 3, i.e. the light-emitting device 1 of the type wherein the interior of an airtight container 10 was evacuated through an exhaust hole 12, was prepared. Further, the coating, drying and curing of the sealing composition of a paste-form, were carried out in the same procedure as described with respect to evaluation of leakage.

The specifications of the respective constituting elements were as follows.

Front substrate: White plate (B270, manufactured by Shot Co.), 108 mm×75 mm×2.5 mm Rear substrate: White plate (B270, manufactured by Shot Co.), 108 mm×75 mm×2.5 mm Spacer component: Made of soda lime glass, 5 mm in width×7 mm in height Electrodes: Silver electrodes (thickness: 10 μm) were screen-printed at intervals of 6 mm Dielectric layer: Lead oxide was screen-printed so that the thickness became 50 μm.

Phosphor layer: A solution having three primary color phosphors (green color: $Zn_2SiO_4$:Mn, red color: (Y,Gd) Y,Gd)$BO_3$:Eu, blue color: $BaMgAl_{10}O_{17}$:Eu) dissolved, was applied to form a phosphor layer having a thickness of 50 μm.

Discharge gas: The airtight container was evacuated at 250° C. for 1 hour, and then, xenon gas was filled as a discharge gas.

The obtained light-emitting device was connected to an alternating current power source to apply an alternating current voltage having an amplitude exceeding the discharge voltage thereby to let the phosphor emit light. With respect to the light emitted from the front substrate, the luminance was measured by means of a luminance meter, and the color temperature was measured by means of a color temperature meter. The results are shown in Table 1.

Example 2

A sealing composition was prepared in the same manner as in Example 1 except that a spherical filler having an average particle diameter of 1 μm was used, and evaluation of the obtained sealing composition was carried out. The results are shown in Table 1.

Example 3

Evaluation was carried out by using a sealing composition prepared in the same manner as in Example 1 except that evaluation of properties of the light-emitting device was not carried out. However, in Example 3, the sealing composition was partially polymerized in the same manner as in Example 1 and then molded into a desired shape by casting into a mold made of a fluororesin, and the sealing composition was used in the form of the molded product.

Example 4

The operation was carried out in the same manner as in Example 3 except that as shown in Table 1, 15 parts by mass of a curable methylphenyl silicone resin and 85 parts by mass of a spherical silica having an average particle diameter of 3 μm, were incorporated. The results are shown in Table 1. This composition had a filler content as large as 85 parts by mass, whereby the fluidity was poor, and the coating efficiency was poor. Further, the bond strength to glass was weak, it was peeled before carrying out evaluation of leakage and evaluation of bond strength to glass, whereby it was impossible to carry out such evaluations.

Example 5

The operation was carried out in the same manner as in Example 3 except that as a curable methylphenyl silicone resin, one prepared solely of a trifunctional silicon monomer was used. The results are shown in Table 1. Such a composition had a weak bond strength to glass and was peeled before carrying out evaluation of leakage and evaluation of the bond strength to glass, and it was impossible to carry out such evaluations.

Example 6 and 7

In Example 6 and 7, evaluation was carried out in the same manner as in Example 1 by using, instead of the sealing composition of the present invention, conventional lead-type glass frit (Example 6: DT430, manufactured by Asahi Techno Glass Corporation, Example 7: one formed into a paste-form by adding a solvent and a binder to glass frit). However, in Examples 6 and 7, evaluation of bond strength to glass was not carried out. Further, the sealing temperature was 430° C. in Example 6, and 520° C. in Example 7. The results are shown in Table 1. In these Examples wherein conventional lead-type glass frit was used as the sealing material, in the evaluation of emission characteristics of the light-emitting devices, each of the color temperature and luminance was poor as compared with Example 1, thus indicating heat deterioration of the phosphor due to high temperature sealing.

TABLE 2-continued

| Material | Lead-type low melting point glass | Ex. 6 DT 430 (manufactured by Asahi Techno Glass Corporation) | Ex. 7 Paste-form glass frit having a solvent and a binder added |
|---|---|---|---|
| Evaluation of properties | Bond strength to glass ($MNm^{-2}$) | — | — |
| | Leakage | Nil | Nil |
| Emission characteristics | Color temperature (K) | 10,000 | 10,000 |
| | Luminance (cd) | 8,000 to 9,000 | 6,000 to 7,000 |

The present application is based on a Japanese Patent Application No. 2004-51776 filed on Feb. 26, 2004, and the entire disclosure thereof is hereby included by reference.

What is claimed is:

1. A light-emitting device having an airtight container constituted by a front substrate, a rear substrate disposed to face the front substrate and a spacer component disposed between the front substrate and the rear substrate to maintain a certain distance between the front substrate and the rear substrate, wherein a joint portion between the front substrate and the spacer component and a joint portion between the rear substrate and the spacer component, are sealed with sealing materials, at least one of the sealing materials used at the two joint portions is made of a sealing composition comprising a curable methylphenyl silicone resin and a refractory filler, the amount of the refractory filler based on the sum of the methylphenyl silicone resin and the refractory filler in the sealing composition, is from 10 to 80 mass %, and the methylphenyl silicone resin has a molar ratio of phenyl groups to methyl groups (i.e. mols of phenyl groups/mols of methyl groups) of from 0.1 to 1.2.

2. The light-emitting device according to claim 1, wherein the methylphenyl silicone resin has a molar ratio of bifunctional silicon units to (the sum of bifunctional silicon units and trifunctional silicon units) (i.e. mols of bifunctional

TABLE 1

| | | Ex. 1 | Ex. 2 | Ex. 3 | Ex. 4 | Ex. 5 |
|---|---|---|---|---|---|---|
| Material | Amount of methylphenyl silicone | 40 | 40 | 40 | 15 | 40 |
| | Molar ratio of bifunctional silica units | 0.25 | 0.25 | 0.25 | 0.25 | 0 |
| | Mols of phenyl groups/mols of methyl groups | 0.6 | 0.6 | 0.6 | 0.6 | 0.7 |
| | Average particle diameter of filler | 3 μm | 1 μm | 3 μm | 3 μm | 3 μm |
| | Amount of filler | 60 | 60 | 60 | 85 | 60 |
| Form of sealing material | Form | Paste | Paste | Solid | Solid | Solid |
| | Sealing composition: solvent | 9:1 | 9:1 | 10:0 | 10:0 | 10:0 |
| Operation efficiency | Coating efficiency | ○ | ○ | ○ | X | ○ |
| | Curability | ○ | ○ | ○ | ○ | ○ |
| | Sealing temp. (° C.) | 200, 250 | 200, 250 | 200, 250 | 200, 250 | 200, 250 |
| Evaluation of properties | Bond strength to glass ($MNm^{-2}$) | 14 | 14 | 15 | N.A. | N.A. |
| | Leakage | Nil | Nil | Nil | N.A. | N.A. |
| Emission characteristics | Color temperature (K) | 15,000 to 30,000 | 15,000 to 30,000 | — | — | — |
| | Luminance (cd) | 6,000 to 10,000 | 6,000 to 10,000 | — | — | — |

TABLE 2

| Material | Lead-type low melting point glass | Ex. 6 DT 430 (manufactured by Asahi Techno Glass Corporation) | Ex. 7 Paste-form glass frit having a solvent and a binder added |
|---|---|---|---|
| Operation efficiency | Coating efficiency | ○ | ○ |
| | Curability | ○ | ○ |
| | Sealing temp. (° C.) | 430 | 520 |

silicon units/(total mols of bifunctional silicon units and trifunctional silicon units)) of from 0.05 to 0.55.

3. The light-emitting device according to claim 1, wherein the refractory filler is spherical silica having an average particle diameter of from 0.1 to 20 μm.

4. The light-emitting device according to claim 1, wherein each of the sealing materials used at the two joint portions is made of said sealing composition.

5. The light-emitting device according to claim 1, which has electrodes and a dielectric layer covering the electrodes, on a surface of the rear substrate in the airtight container, and which has a phosphor layer on a surface of the front substrate in the airtight container, wherein a discharge gas is sealed in the airtight container.

6. The light-emitting device according to claim 5, which has a phosphor layer on a surface of the dielectric layer.

7. The light-emitting device according to claim 5, wherein the light-emitting device is a flat fluorescent screen.

8. A light-emitting device having an airtight container constituted by a front substrate, a rear substrate disposed to face the front substrate, a spacer component disposed between the front substrate and the rear substrate to maintain a certain distance between the front substrate and the rear substrate, and a sealed exhaust hole, wherein the sealed exhaust hole is sealed with a sealing material, the sealing material is made of a sealing composition comprising a curable methylphenyl silicone resin and a refractory filler, the amount of the refractory filler based on the sum of the methylphenyl silicone resin and the refractory filler in the sealing composition, is from 10 to 80 mass %, and the methylphenyl silicone resin has a molar ratio of phenyl groups to methyl groups (i.e. mols of phenyl groups/mols of methyl groups) of from 0.1 to 1.2.

9. The light-emitting device according to claim 8, wherein the methylphenyl silicone resin has a molar ratio of bifunctional silicon units to (the sum of bifunctional silicon units and trifunctional silicon units) (i.e. mols of bifunctional silicon units/(total mols of bifunctional silicon units and trifunctional silicon units)) of from 0.05 to 0.55.

10. The light-emitting device according to claim 8, wherein the refractory filler is spherical silica having an average particle diameter of from 0.1 to 20 μm.

11. The light-emitting device according to claim 8, which has electrodes and a dielectric layer covering the electrodes, on a surface of the rear substrate in the airtight container, and which has a phosphor layer on a surface of the front substrate in the airtight container, wherein a discharge gas is sealed in the airtight container.

12. The light-emitting device according to claim 11, wherein the light-emitting device is a flat fluorescent screen.

13. A process for producing a light-emitting device, which comprises applying a sealing composition to a joint surface between a front substrate and a spacer component or to a joint surface between a rear substrate and the spacer component and then, heating and curing the sealing composition to form an airtight container, wherein the sealing composition comprises a curable methylphenyl silicone resin and a refractory filler, the amount of the refractory filler based on the sum of the methylphenyl silicone resin and the refractory filler in the sealing composition, is from 10 to 80 mass %, the methylphenyl silicone resin has a molar ratio of phenyl groups to methyl groups (i.e. mols of phenyl groups/mols of methyl groups) of from 0.1 to 1.2, the methylphenyl silicone resin has a molar ratio of bifunctional silicon units to (the sum of bifunctional silicon units and trifunctional silicon units) (i.e. mols of bifunctional silicon units/(total mols of bifunctional silicon units and trifunctional silicon units)) of from 0.05 to 0.55, and the refractory filler is spherical silica having an average particle diameter of from 0.1 to 20 μm.

14. The process for producing a light-emitting device according to claim 13, wherein before bonding the front substrate and the spacer component and/or before bonding the rear substrate and the spacer component, electrodes and a dielectric layer covering the electrodes, are formed on a surface of the rear substrate constituting the inner surface of the airtight container, and a phosphor layer is formed on a surface of the front substrate constituting the inner surface of the airtight container, and after forming the airtight container, a discharge gas is filled in the airtight container.

15. The process for producing a light-emitting device according to claim 14, wherein the light-emitting device is a flat fluorescent screen.

16. A process for producing a light-emitting device, which comprises forming an airtight container constituted by a front substrate, a rear substrate disposed to face the front substrate, and a spacer component disposed between the front substrate and the rear substrate to maintain a certain distance between the front substrate and the rear substrate, and having an exhaust hole, then evacuating the interior of the airtight container through the exhaust hole, filling it with a discharge gas, and then, sealing the exhaust hole with a sealing composition, to form the airtight container filled with the discharge gas, wherein the sealing composition comprises a curable methylphenyl silicone resin and a refractory filler, the amount of the refractory filler based on the sum of the methylphenyl silicone resin and the refractory filler in the sealing composition, is from 10 to 80 mass %, the molar ratio of phenyl groups to methyl groups (i.e. mols of phenyl groups/mols of methyl groups) in the methylphenyl silicone resin is from 0.1 to 1.2, the molar ratio of bifunctional silicon units to (the sum of bifunctional silicon units and trifunctional silicon units) (i.e. mols of bifunctional silicon units/(total mols of bifunctional silicon units and trifunctional silicon units)) in the methylphenyl silicone resin is from 0.05 to 0.55, and the refractory filler is spherical silica having an average particle diameter of from 0.1 to 20 μm.

17. The process for producing a light-emitting device according to claim 16, wherein a sealing plate is bonded by means of the sealing composition at the exhaust hole opening on the surface of the airtight container.

18. The process for producing a light-emitting device according to claim 16, which has electrodes and a dielectric layer to cover the electrodes, on a surface of the rear substrate inside of the airtight container, and which has a phosphor layer on a surface of the front substrate inside of the airtight container.

19. The process for producing a light-emitting device according to claim 18, wherein the light-emitting device is a flat fluorescent screen.

20. A sealing composition comprising a curable methylphenyl silicone resin and a refractory filler, characterized in that the amount of the refractory filler based on the sum of the methylphenyl silicone resin and the refractory filler in the sealing composition, is from 10 to 80 mass %, the molar ratio of phenyl groups to methyl groups (i.e. mols of phenyl groups/mols of methyl groups) in the methylphenyl silicone resin is from 0.1 to 1.2, the molar ratio of bifunctional silicon units to (the sum of bifunctional silicon units and trifunctional silicon units) (i.e. mols of bifunctional silicon units/(total mols of bifunctional silicon units and trifunctional silicon units)) in the methylphenyl silicone resin is from 0.05 to 0.55, and the refractory filler is spherical silica having an average particle diameter of from 0.1 to 20 μm.

* * * * *